US006739920B2

(12) United States Patent
Fujii et al.

(10) Patent No.: US 6,739,920 B2
(45) Date of Patent: May 25, 2004

(54) JOINT CONNECTOR

(75) Inventors: Masayasu Fujii, Yokkaichi (JP); Toshikazu Sakurai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/223,758

(22) Filed: Aug. 19, 2002

(65) Prior Publication Data

US 2003/0040224 A1 Feb. 27, 2003

(30) Foreign Application Priority Data

Aug. 21, 2001 (JP) ..... 2001-250021

(51) Int. Cl.[7] ..... H01R 11/09
(52) U.S. Cl. ..... 439/723
(58) Field of Search ..... 439/723, 721, 439/72.1, 212, 949

(56) References Cited

U.S. PATENT DOCUMENTS 4,174,878 A * 11/1979 Debaigt ..... 439/752
5,295,858 A * 3/1994 Kasai et al. ..... 439/404
5,322,445 A * 6/1994 Ozaki et al. ..... 439/212
5,490,794 A * 2/1996 Kobayashi et al. ..... 439/212
5,605,465 A * 2/1997 Kobayashi et al. ..... 439/76.2
5,624,280 A * 4/1997 Kato ..... 439/724
5,645,455 A * 7/1997 Seki ..... 439/723
5,908,322 A * 6/1999 Seki ..... 439/212

* cited by examiner

*Primary Examiner*—Ross Gushi
(74) *Attorney, Agent, or Firm*—Gerald E. Hespos; Anthony J. Casella

(57) ABSTRACT

A joint connector (40) is composed of a joint terminal (50) and a relay housing (41). A first housing (10) and a second housing (20) are mounted on an electric part-side connector connection portion (42) of the relay housing (41). A power-source side housing (30) is mounted on a power-source side connector connection portion (46). Terminal fittings are short-circuited with the joint terminal (50). The first housing (10) and the second housing (20) share the power-source side housing (30) and the joint connector (40).

5 Claims, 13 Drawing Sheets

JOINT CONNECTOR

BACKGROUND OF THE INVENTION

1. Field of the Invention

The present invention relates to a joint connector.

2. Description of the Related Art

Electric power is supplied to electric parts from a power-supply, such as a battery. More particularly, a first harness is connected to the power supply and a second harness is connected to the electric-parts. The harnesses then are relayed with a joint connector. FIG. 16 shows the joint connector disclosed in U.S. Pat. No. 5,645,455. This joint connector 101 is used with an electric part housing 102 mounted on an end of a harness at the electric-part side and a power-source housing 103 mounted on an end of a harness at the power side. The electric part housing 102 and the electric source housing 103 are fit on each other in a one-to-one correspondence.

An increase of the number of the electric-part side harnesses causes an increase in the number of the joint connectors 101, power-source side housings 103, and harnesses to be relayed. That is, as the number of the electric part housings 102 increases, the electric part housings 102 and the power-source side housings 103 keep one-to-one correspondence. In this joint connector, since one system is composed of three component parts, two systems are composed of six component parts. This is a problem to be solved.

The present invention has been made in view of the above-described situation. Accordingly, it is an object of the present invention to provide a joint connector that allows a reduction in the number of component parts in relaying a plurality of systems.

SUMMARY OF THE INVENTION

The invention is directed to a joint connector with a relay housing that accommodates joint terminals. The joint connector connects a first-side connector that is connected to at least one harness to a plurality of second-side connectors that are connected to a plurality of harnesses. Thus, the second-side connectors share the first-side connector, and a branch connection between the first-side connector and the second-side connectors is made through the joint terminals.

The relay housing preferably has a first and second connection portions. The first connection portion is connected to the first-side connector. The second connection portion is partitioned by at least one partitioning wall into plural parts that are connected respectively to the second-side connectors. The joint terminals preferably are installed on the relay housing in a direction from the first connection portion, and the joint terminals stride over the partitioning wall to make a branch connection between the second-side connectors that are adjacent to each other. Thus the partitioning wall is interposed between the second-side connectors.

The second-side connectors share the first-side connector. Therefore it is possible to make the number of component parts smaller than the conventional art in which the first-side connector and the second-side side connector fit on each other in a one-to-one relationship.

The joint terminal is installed on the relay housing in the direction from the first-side connector connection portion. Thus, it is possible to mount the joint terminal on the relay housing after the relay housing is molded, with the joint terminal striding over the partitioning wall.

Therefore it is possible to accomplish a branch connection of the second-side housings adjacent to each other, with the partitioning wall interposed therebetween.

DETAILED DESCRIPTION OF THE PREFERRED EMBODIMENTS

Figure 1:
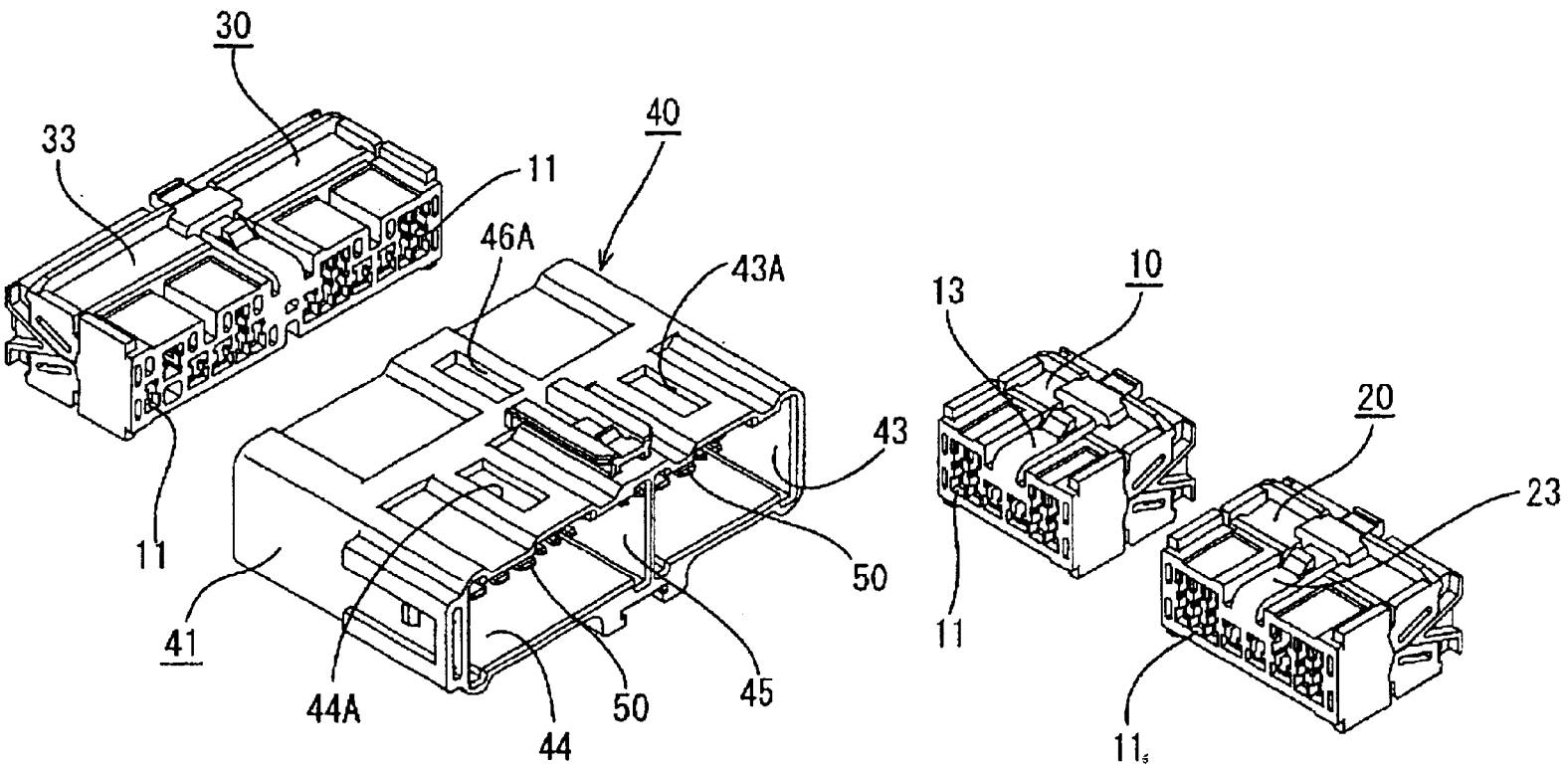
FIG. 1 is an exploded perspective view showing connectors relaying a harness in one embodiment of the present invention.
Figure 2:
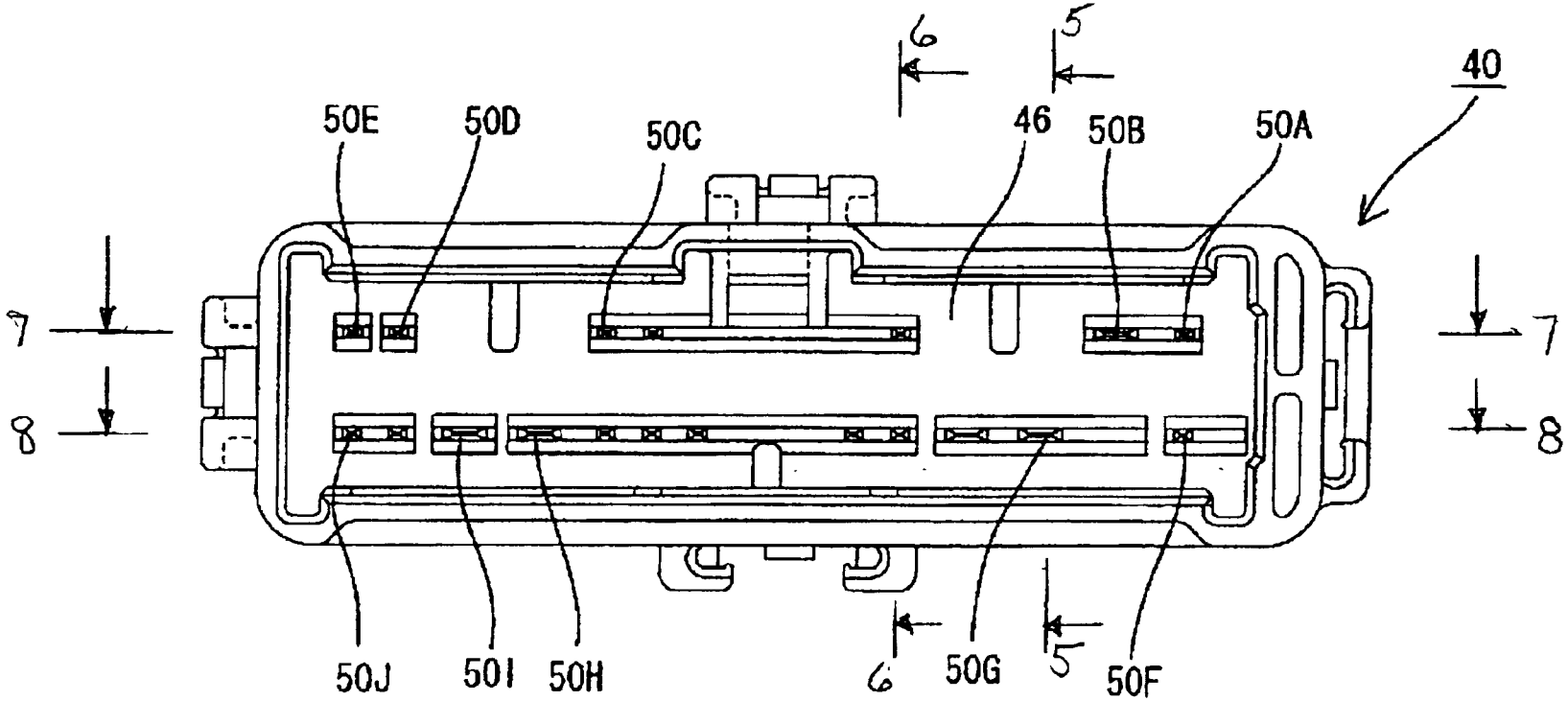
FIG. 2 is a front view showing a joint connector.
Figure 3:
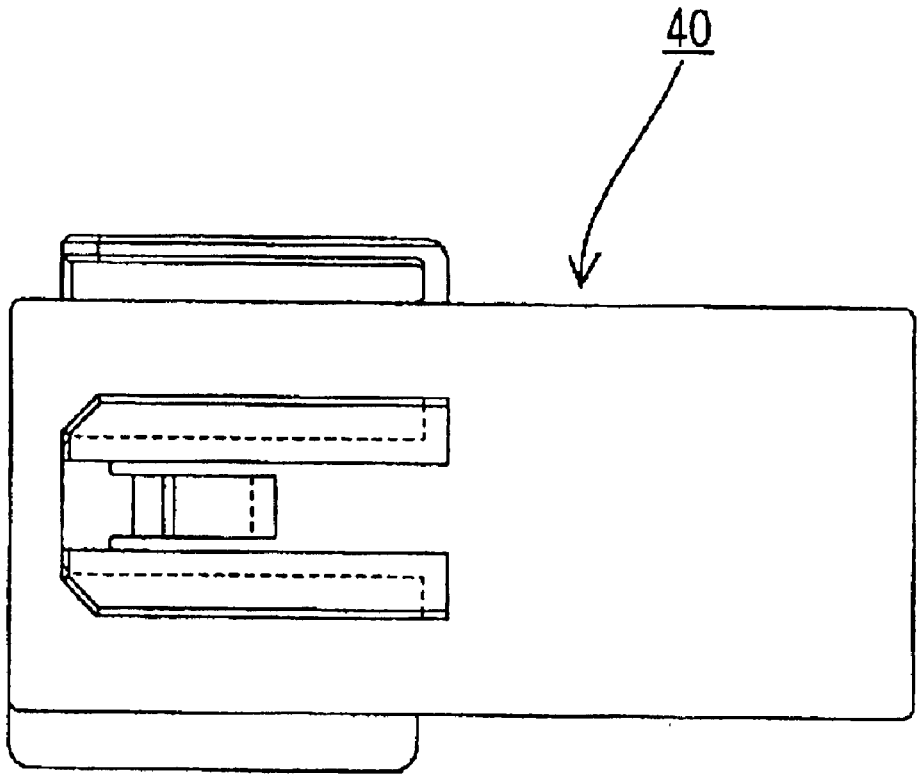
FIG. 3 is a right side view of the joint connector.
Figure 4:
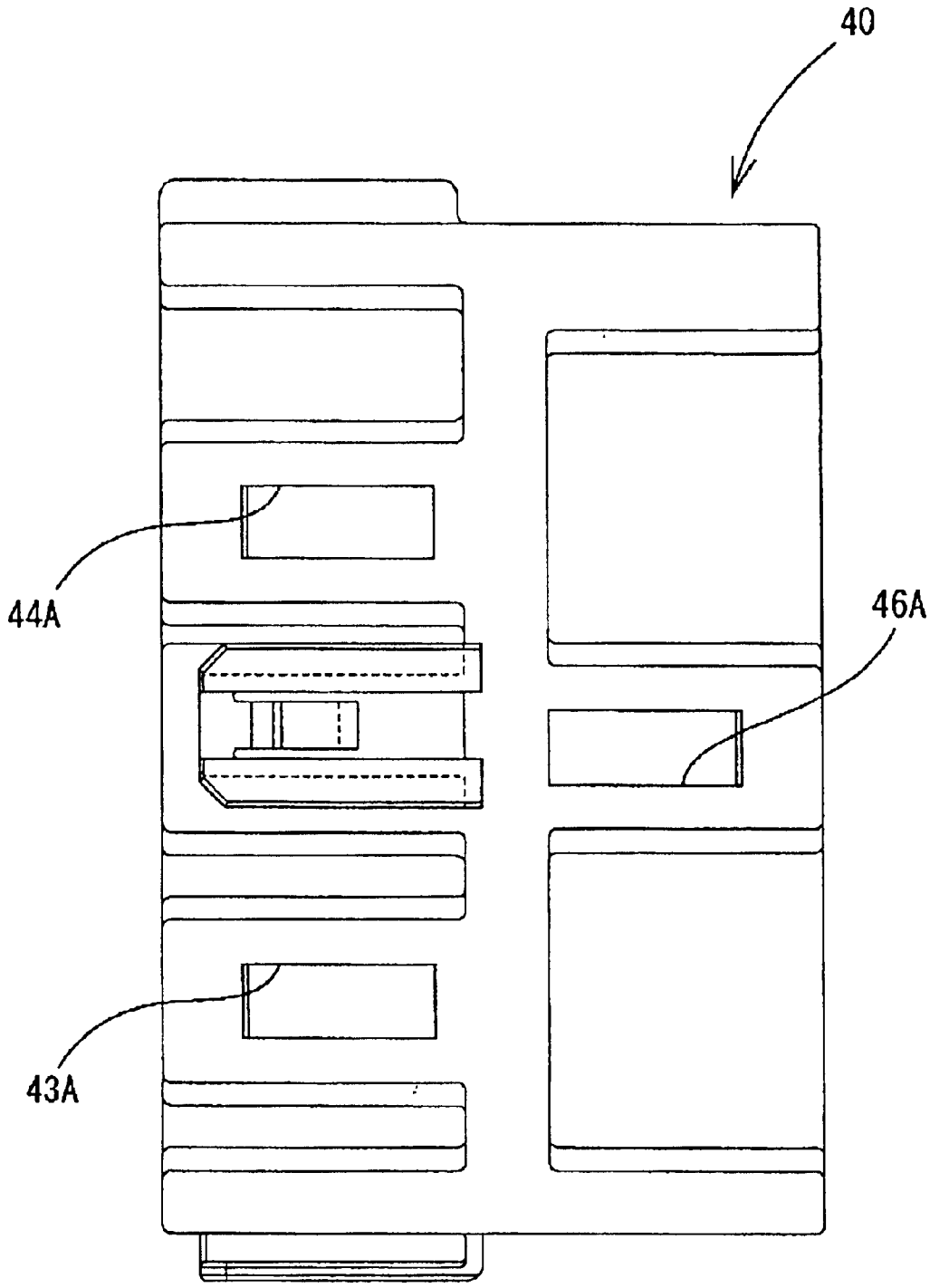
FIG. 4 is a top plan view of the joint connector.

A first electric-part side female housing 10 and a second electric-part side female housing 20 are illustrated in FIG. 1. The first and second housings 10, 20 are connected to terminals of harnesses that are connected respectively to at least one unillustrated electric part. The first housing 10 is formed with a resiliently deflectable lock arm 13. Similarly, the second housing 20 is formed with a resiliently deflectable lock arm 23. A power-source side female connector housing 30 is connected to terminals of a harness connected to an unillustrated power source and is formed with a resiliently deflectable lock arm 33.

The first and second housings 10, 20 are relayed to the power-source side housing 30 with a joint connector 40. The joint connector 40 includes a relay housing 41 and joint terminals 50.

Figure 5:
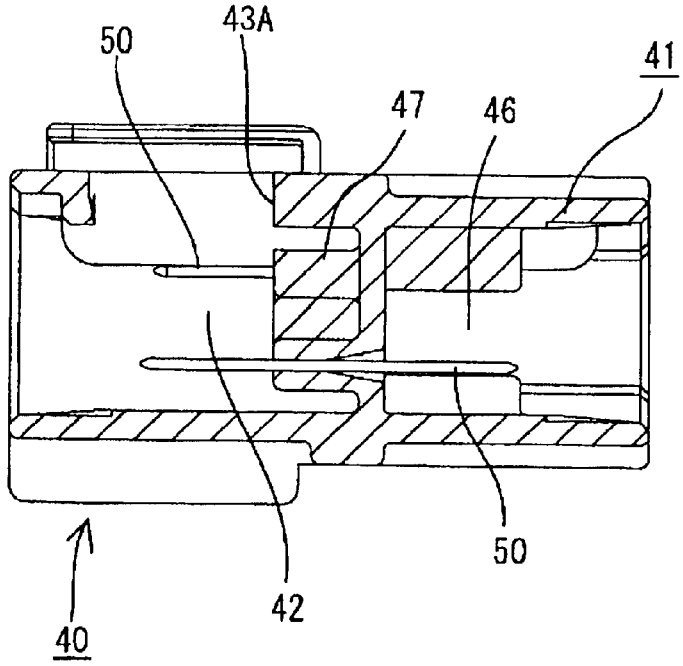
FIG. 5 is a sectional view taken along a line 5—5 of FIG. 2.
Figure 6:
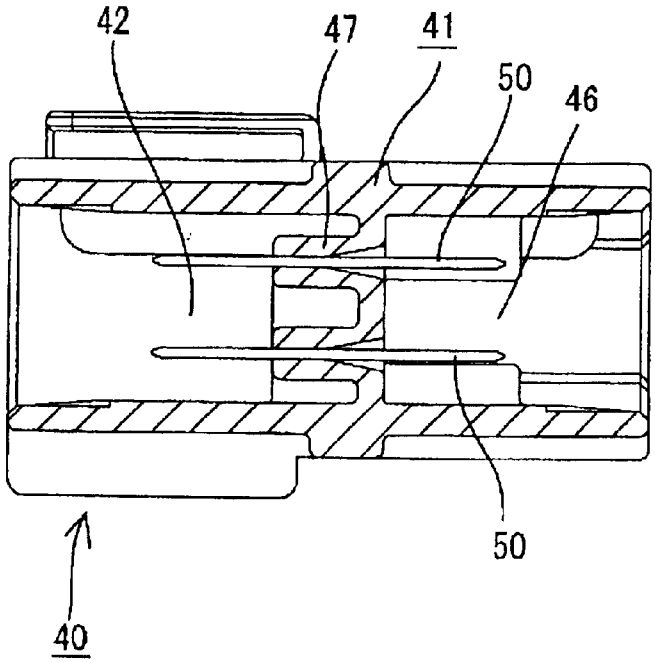
FIG. 6 is a sectional view taken along a line 6—6 of FIG. 2.

The relay housing 41 is made of resin, and is in the form of a longitudinally open rectangular pillar. As shown in FIGS. 5 and 6, a separation wall 47 extends parallel to the ends and partitions the inside of the relay housing 41 into an electric-part side connector connection portion 42 and a power-source side connector connection portion 46.

Figure 7:
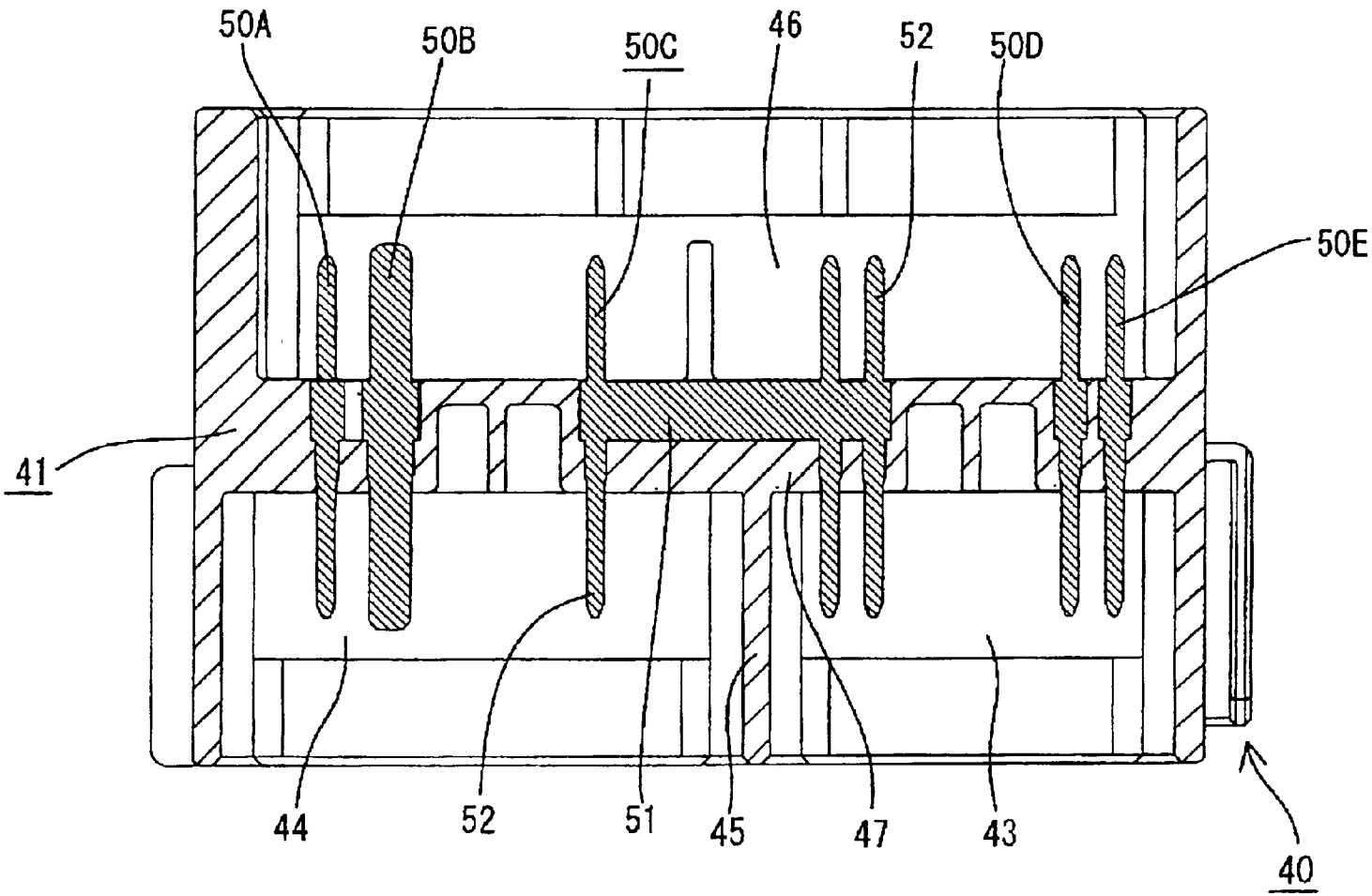
FIG. 7 is a sectional view taken along a line 7—7 of FIG. 2.
Figure 8:
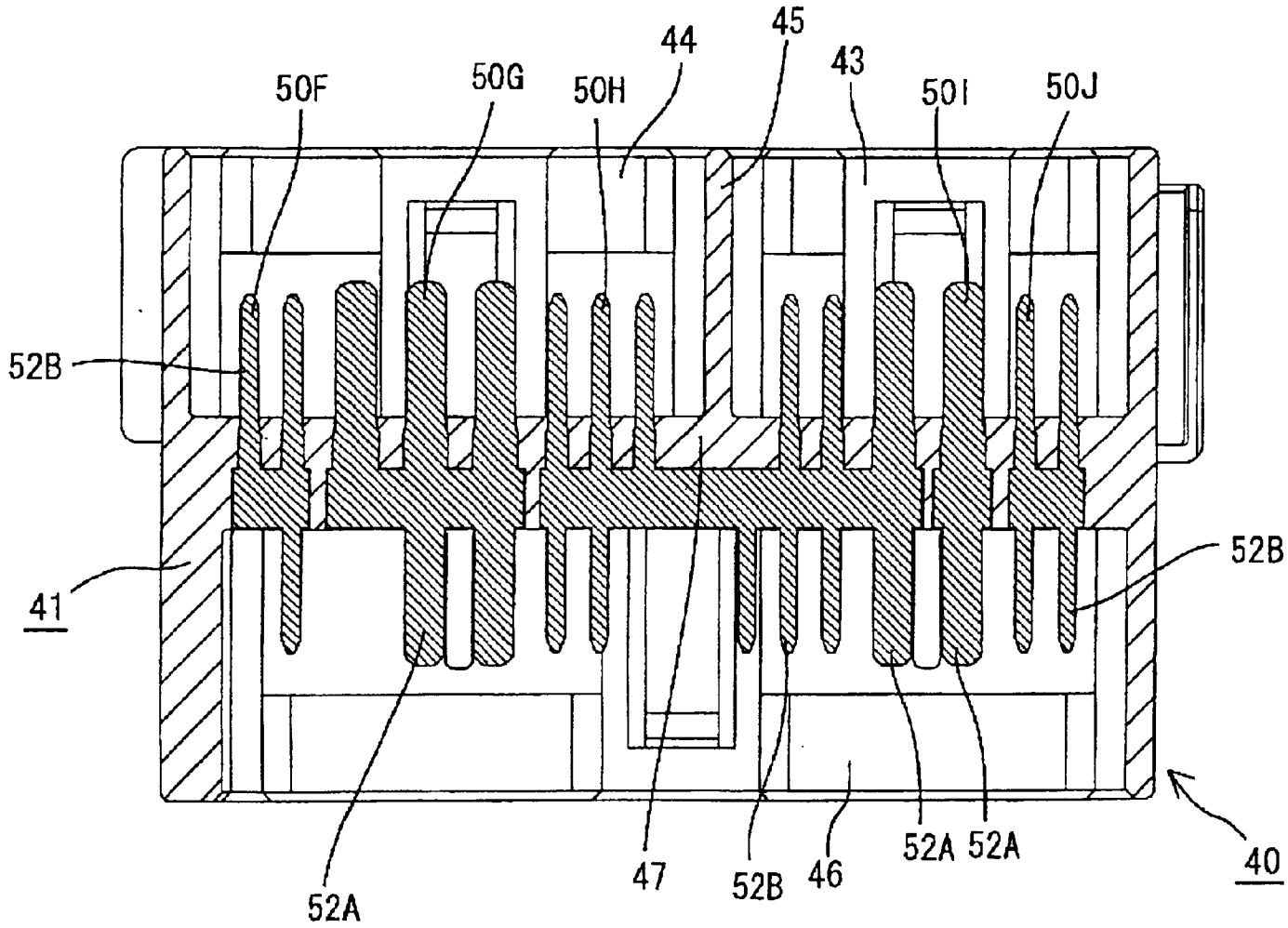
FIG. 8 is a sectional view taken along a line 8—8 of FIG. 2.

As shown in FIGS. 7 and 8, a partitioning wall 45 is formed in the electric part-side connector connection portion 42 to partition the electric part-side connector connection portion 42 into a right accommodation chamber 43 and a left accommodation chamber 44. Locking holes 43A and 44A are formed on an upper surface of the right accommodation chamber 43 and the left accommodation chamber 44 respectively. The first housing 10 can be connected to the right accommodation chamber 43, and can be locked therein by releasably engaging the lock arm 13 in the locking hole 43A. Similarly the second housing 20 can be connected to the left accommodation chamber 44, and can be locked therein by releasably engaging the lock arm 23 in the locking hole 44A. A locking hole 46A is formed on an upper surface of the power-source side connector connection portion 46. The power-source side housing 30 can be connected to the power-source side connector connection portion 46, and can be locked therein by releasably engaging the lock arm 33 in the locking hole 46A.

Figure 9:
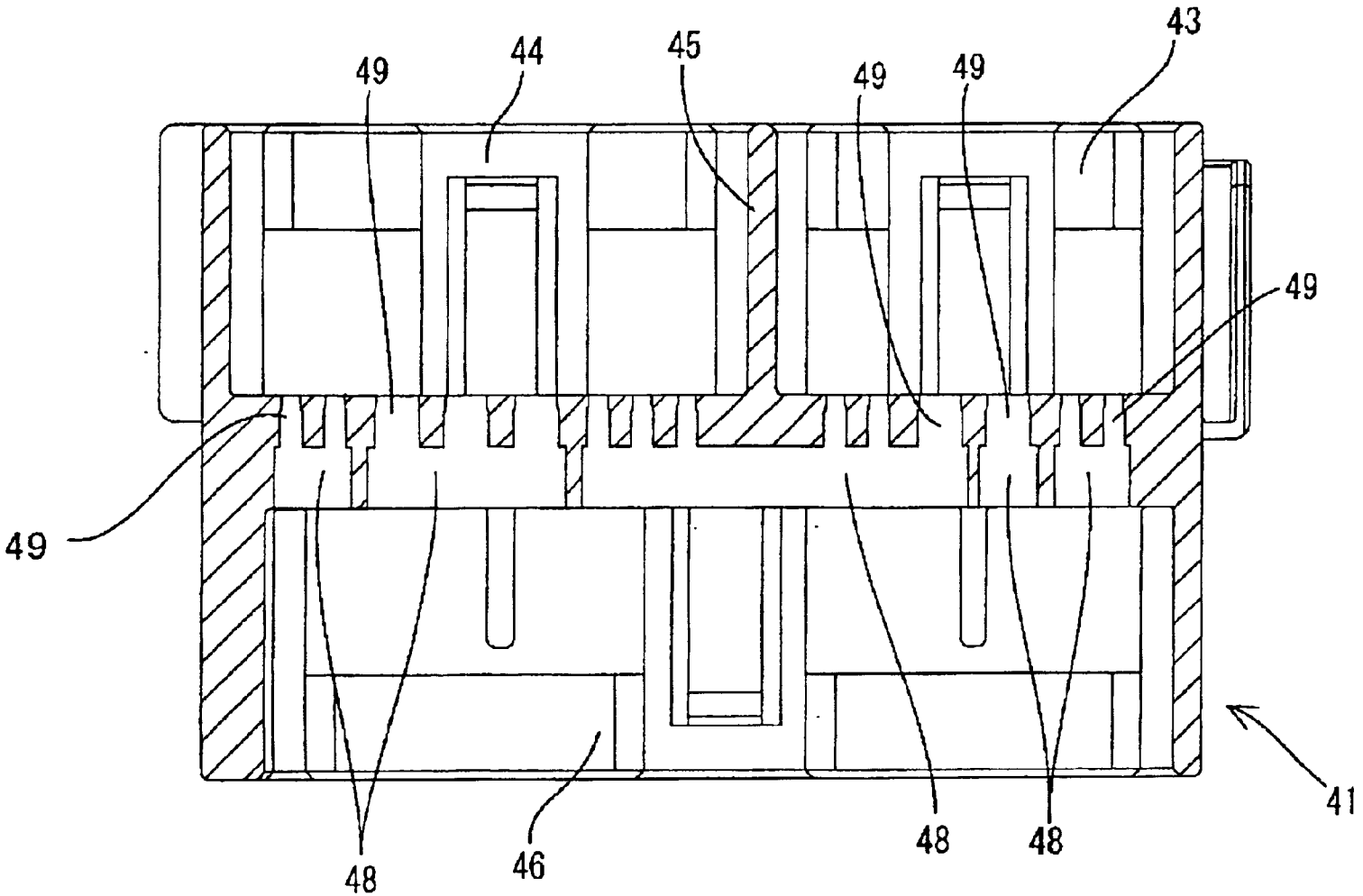
FIG. 9 is a horizontal sectional view showing a relay housing.

A slit-shaped installing cavity 48 is formed at a side of the separation wall 47 corresponding to the power-source side connector connection portion 46, and a joint terminal 50 is pressed therein. Tab insertion holes 49 are formed in the separation wall 47 and provide communication between each installing cavity 48 and the electric part-side connector connection portion 42 (see FIG. 9).

The joint terminals 50 are formed by press-molding a conductive plate material. Each joint terminal 50 has a base 51 and a plurality of tabs 52 that project from both sides of the base 51 (see FIG. 7). Each base 51 is dimensioned to be inserted into the corresponding installing cavity 48. When the joint terminal 50 has been inserted into the corresponding installing cavity 48, the tabs 52 project into the electric part-side connector connection portion 42 and the power-source side connector connection portion 46.

FIG. 8 illustrates wide tabs 52A and narrow tabs 52B. The widths of the respective tabs 52A and 52B are selected in correspondence to the magnitude of a current capacity.

The joint terminals 50 are disposed in upper and lower stages of the separation wall 47, as shown in FIGS. 7 and 8. FIG. 7 shows a plurality of joint terminals 50A–50E arranged widthwise at the upper stage of the relay housing 41. FIG. 8 shows a plurality of joint terminals 50F–50J arranged widthwise at the lower stage of the relay housing 41. The upper-stage joint terminals 50A–50E and the lower-stage joint terminals 50F–50J are not connected to each other.

The joint terminals 50 are installed in the relay housing 41 in a direction from the power-source side connector connection portion 46, with the joint terminal 50 striding over the partitioning wall 45. More specifically, in the first embodiment, the joint terminal 50C at the upper-stage side and the joint terminal 50H at the lower-stage side are installed in the relay housing 41, with the joint terminals 50C and 50H striding over the partitioning wall 45. That is, each of the joint terminals 50C and 50H have tabs 52 that project into the right accommodation chamber 43 and other tabs 52 that project into the left accommodation chamber 44. The partitioning wall 45 partitions the tabs 52 in the different accommodation chambers 43 and 44 from each other. Accordingly, the tabs 52 in the left accommodation chamber 43 can be connected to terminal fittings of the first housing 10 and the tabs 52 in the right accommodation chamber 44 can be connected to terminal fittings of the second housing 20. Therefore it is possible to accomplish a branch connection of the first and second housings 10 and 20 adjacent to each other, with the partitioning wall 45 interposed between the first and second housings 10 and 20.

The fundamental construction of the first housing 10 and the second housing 20 is the same except for the size, number of cavities and the like. Therefore, the construction of only the first housing 10 is described below. However, parts of the second housing 20 that are the same as those of the first housing 10 are designated by the reference numerals used for the first housing 10. In the following description, the side at which the first housing 10 and the second housing 20 fit on the power-source side housing 30 is referred to as the front side.

Figure 10:
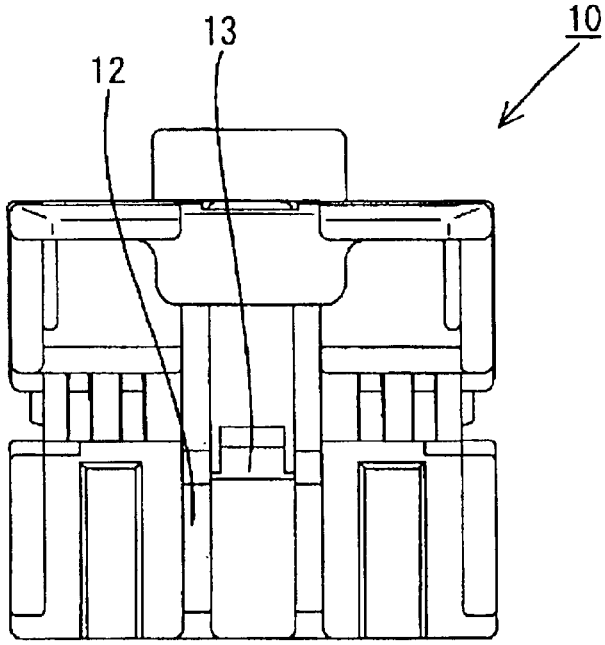
FIG. 10 is a top plan view showing a first housing.
Figure 11:
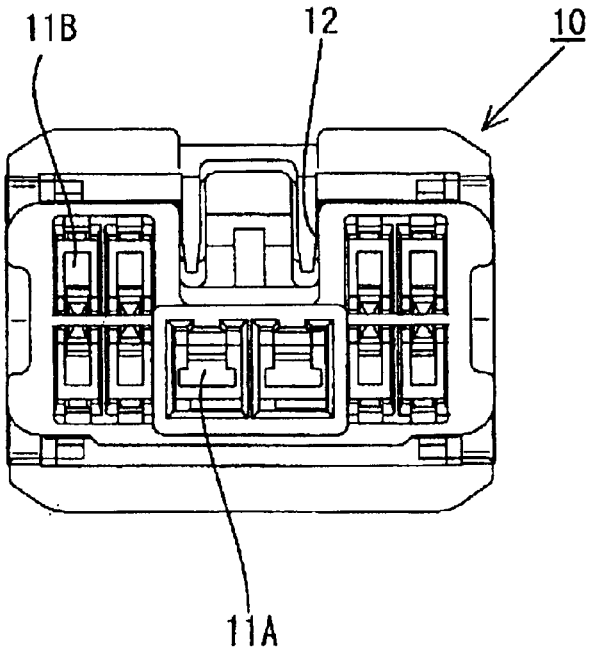
FIG. 11 is a rear view showing the first housing.
Figure 12:
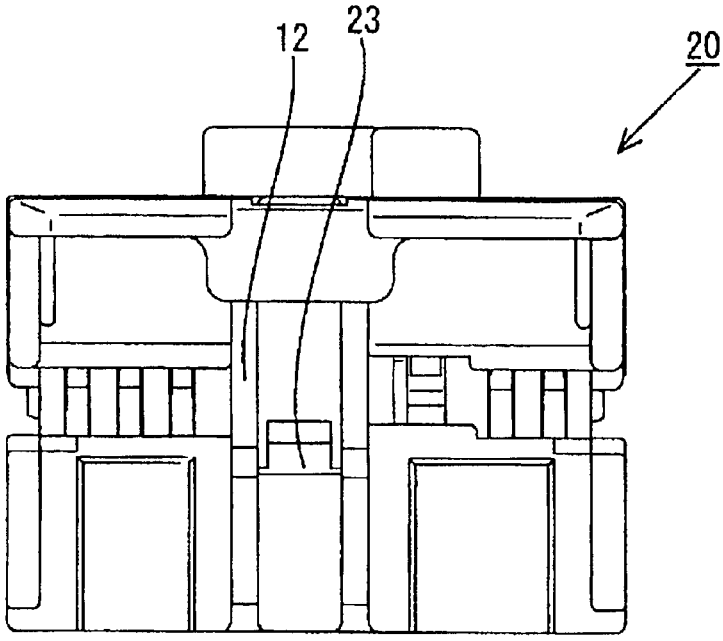
FIG. 12 is a plan view showing a second housing.
Figure 13:
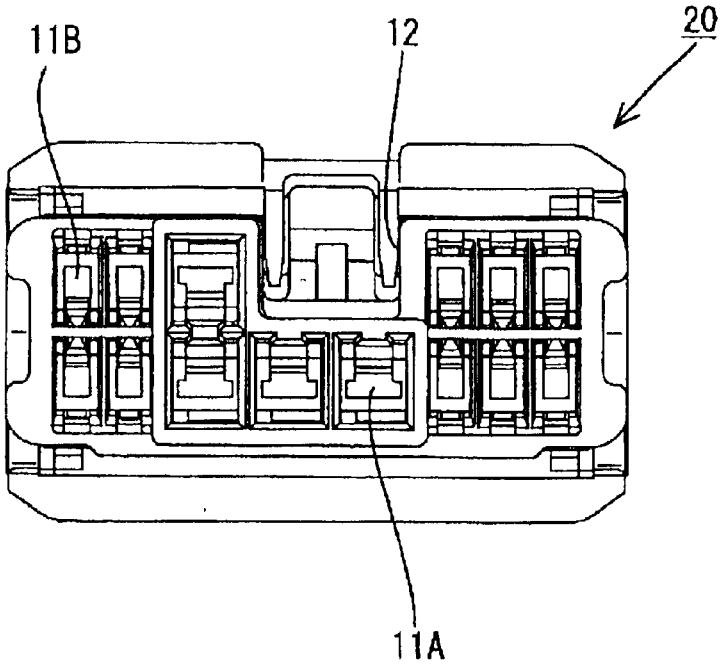
FIG. 13 is a rear view showing the second housing.
Figure 14:
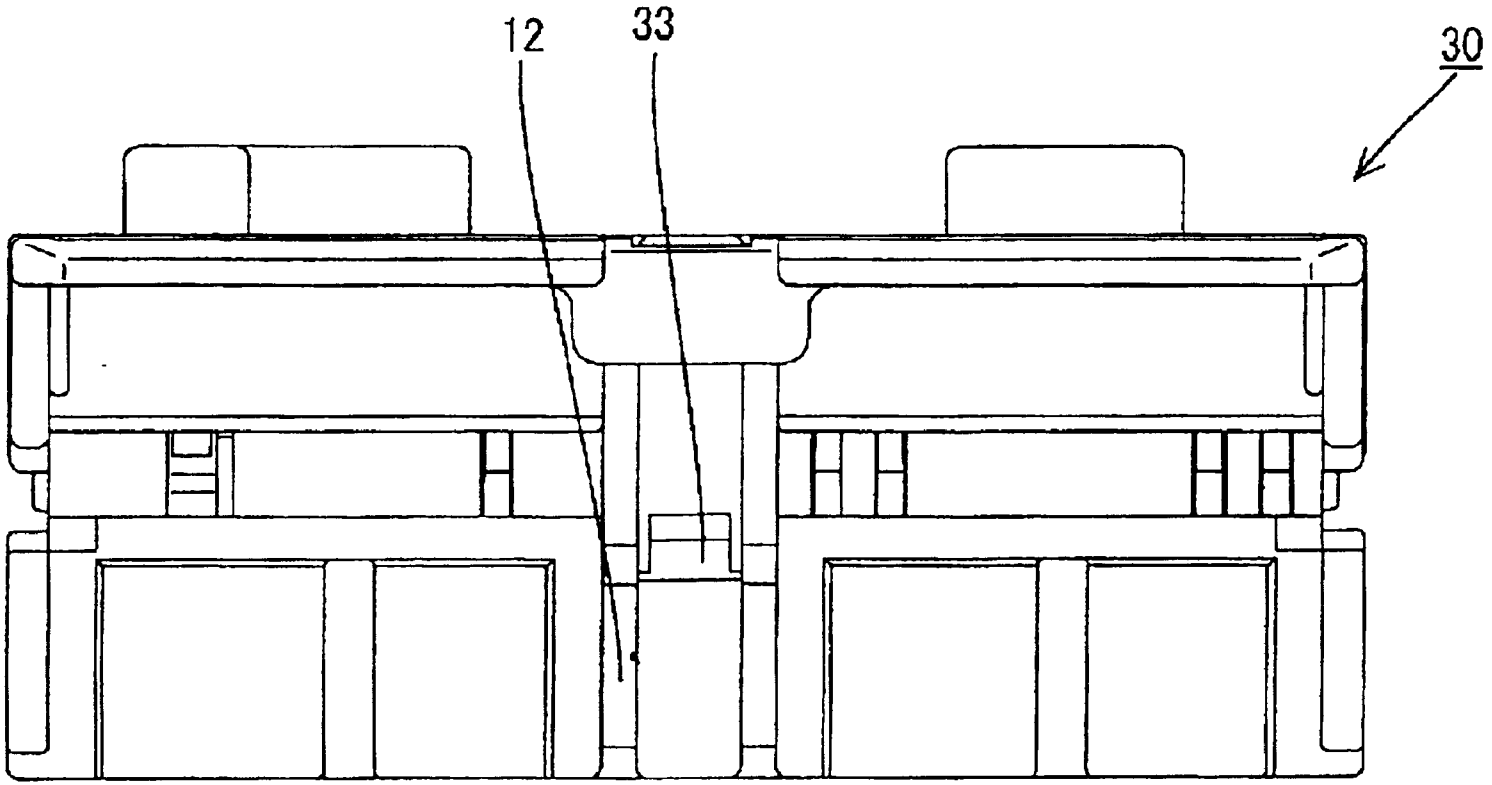
FIG. 14 is a plan view showing a power-source side housing.
Figure 15:
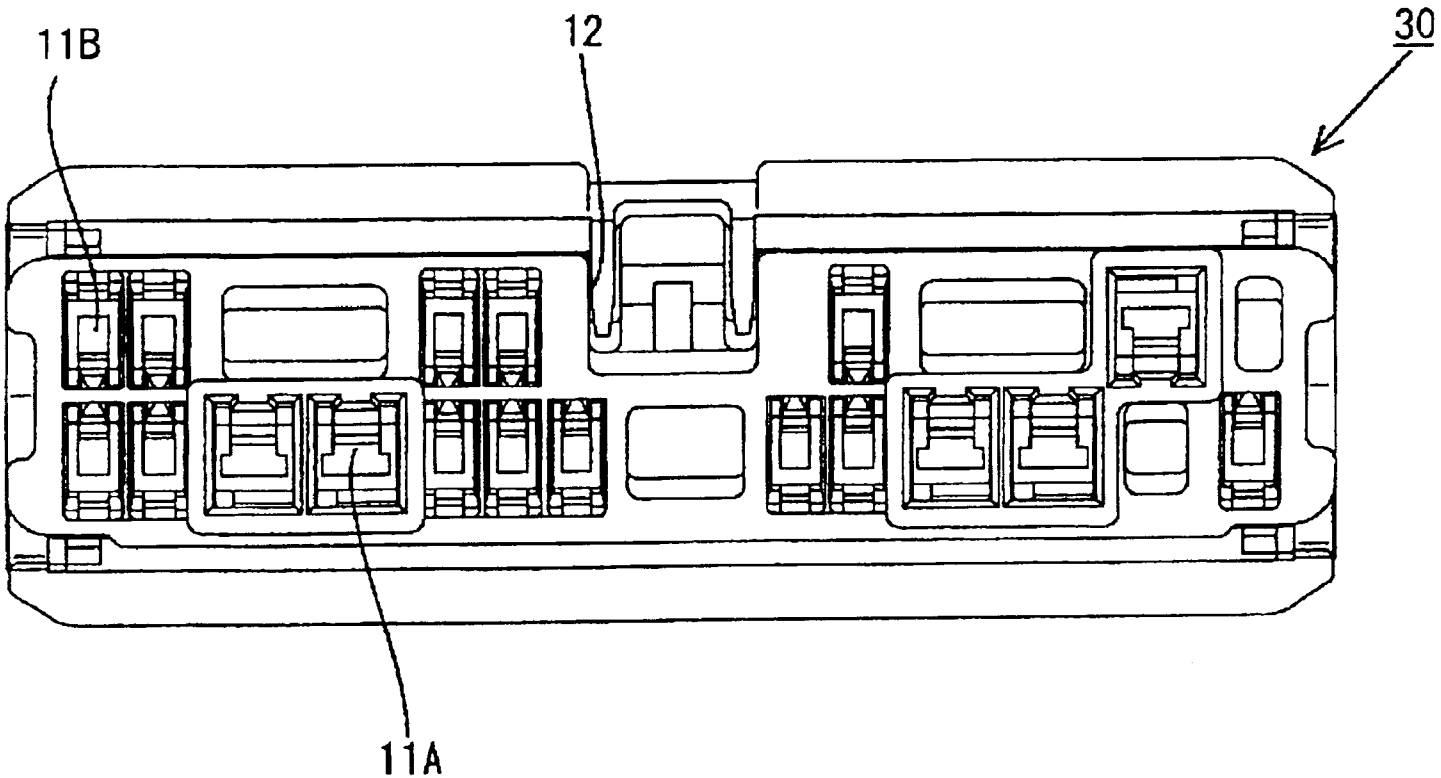
FIG. 15 is a rear view showing the power-source side housing.
Figure 16:
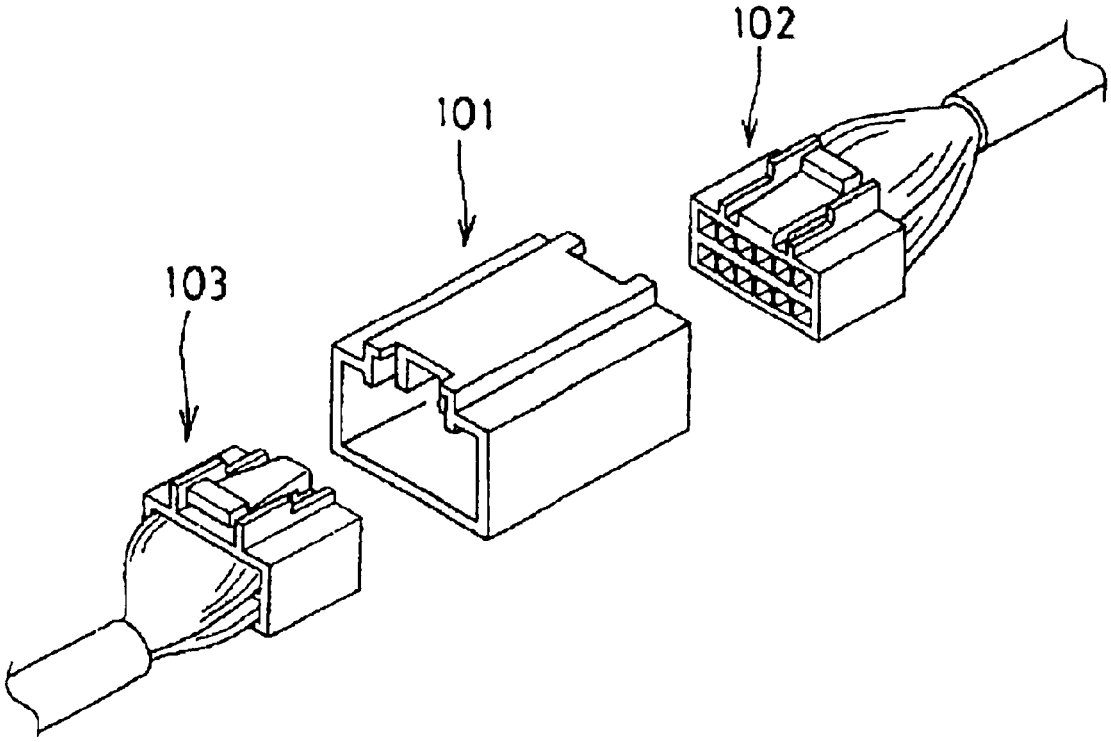
FIG. 16 is an exploded perspective view showing a conventional joint connector.

As shown in FIGS. 1, 10, and 11, the first housing 10 has a substantially solid rectangular shape. Cavities 11 are formed in upper and lower stages in correspondence to the joint terminals 50, and are configured for insertion of terminal fittings (not shown). As described above, the tabs 52 are divided into two groups 52A and 52B whose widths are different from each other. Accordingly, the cavities 11 are divided into two groups 11A and 11B whose sizes are different from each other in correspondence to the tabs 52A and 52B.

A cavity 12 is formed longitudinally between the cavities 11B of the upper stage, and the locking arm 13 is cantilevered at the center of the cavity 12 in its widthwise direction. The first housing 10 is installed in the right accommodation chamber 43 of the relay housing 41 so that the locking arm 13 is locked with the locking hole 43A of the right accommodation chamber 43, and the tab 52 of each joint terminal 50 is connected to the terminal fitting mounted in the first housing 10.

Similarly to the locking arm 23 of the second housing 20 is locked with the locking hole 44A of the left accommodation chamber 44.

The construction of the power-source side housing 30 is substantially the same as that of the first housing 10. Thus, parts of the power-source side housing 30 that are the same as those of the first housing 10 are designated by the reference numerals used for the first housing 10, and description thereof is omitted herein. Only the elements of the power-source side housing 30 that are different from those of the first housing 10 are described below.

As shown in FIG. 1, the power-source side housing 30 is a single member installed on the power-source side connector connection portion 46 of the joint connector 40. One first housing 10 and one second housing 20 are installed on the electric part-side connector connection portion 42. Thus, the first and second housings 10, 20 share the power-source side housing 30.

Similarly to the locking arm 13 of the first housing 10, the locking arm 33 on the power-source side housing 30 is locked to the locking hole 46A of the power-source side connector connection portion 46.

As described above, the power-source side housing 30 is connected to the power-source side connector connection portion 46 of the relay housing 41, and is connected to the first housing 10 and the second housing 20 through the joint terminal 50. That is, a harness from the power source is relayed with the joint connector 40 and branches off to harnesses connected to electric parts. The first housing 10 and the second housing 20 share the power-source side housing 30 and the joint connector 40. Therefore in relaying a plurality of systems, it is possible to make the number of component parts smaller than the conventional art in which the electric part connector and the power-source side connector fit on each other in a one-to-one relationship. More specifically, six component parts are conventionally required to relay harnesses of two systems, whereas in the illustrated embodiment, only four component parts are required to do so.

As described previously, the joint terminal 50 is installed on the relay housing 41 in a direction from the power-source side connector connection portion 46. Thus, the joint terminal 50 is mounted on the previously molded relay housing 41 so that the joint terminal 50 strides over the partitioning wall 45. Therefore it is possible to accomplish a branch connection of the first and second housings 10 and 20 adjacent to each other, with the partitioning wall 45 interposed between the first and second housings 10 and 20.

The present invention is not limited to the embodiment described above with reference to the drawings. For example, the following embodiments are included in the technical scope of the present invention. Further, various modifications can be made without departing from the spirit and scope of the present invention.

In the first embodiment, the harnesses for transmitting an electric power are relayed. In addition, harnesses for transmitting a control signal may be relayed.

In the first embodiment, one power-source side housing is mounted on the power-source side connector connection portion of the relay housing, and the first and second housings are mounted on the electric part-side connector connection portion. However the number of the housings mounted on each connection portion is not limited to a specific number, but any one of the housings should be shared by other housings.

What is claimed is:

1. A joint connector, comprising:

a relay housing molded unitarily from an insulating resin and having open first and second ends, a separation wall spaced from the first and second ends, such that a first chamber is defined between the separation wall and the first end, a partitioning wall extending from the separation wall towards the second end and defining right and left chambers between the separation wall and the second end, at least a first installing cavity being formed in the separation wall, the first installing cavity being open into and facing into the first chamber, at least one right tab insertion hole extending from the installing cavity to the right chamber and at least one left tab insertion hole extending from the installing cavity to the left chamber; and at least a first joint terminal having a base press fit into the installing cavity, first tabs extending from the base out of the installing cavity and into the first chamber, at least one right tab extending from the base through said right tab insertion hole and into the right chamber and at least one left tab extending from the base, through said left tab insertion hole and into the left chamber, such that right and left connectors inserted into the right and left chambers can share power from a connector inserted into the first chamber.

2. The joint connector of claim 1, wherein the joint terminal is formed unitarily from a metallic material.

3. The joint connector of claim 1, further comprising at least a second joint terminal.

4. A joint connector, comprising:

a relay housing molded unitarily from an insulating resin having first and second ends, a separation wall spaced from the first and second ends, a power-side connection portion extending into the first end and extending to the separation wall, an electric part-side connection portion extending into the second end and extending to the separation wall, a partitioning wall formed in the electric part-side connection portion and orthogonal to the second end for defining right and left chambers in the electric part-side connection portion, a plurality of installing cavities being formed in and opened into the power-side connecting portion, tab insertion holes extending from the installing cavities to the electric part-side connection portion, at least one of said installing cavities having tab insertion holes extending to both the right chamber and the left chamber of the electric part-side connection portion; and a plurality of joint terminals, each said joint terminal having a base force fit into one of said installing cavities, at least one power-side tab extending from the base into the power-side connecting portion, and at least one electric part-side tab extending from the base through one of said tab insertion holes and into the electric part-side connection portion, at least one of said joint terminals having at least one electric part-side tab extending into the right chamber and at least one electric part-side tab extending into the left chamber, such that right and left part-side connectors inserted into the right and left chambers share power from a power-side connector inserted into the power-side connection portion.

5. The joint connector of claim 4, wherein the joint terminals each are formed unitarily from a metallic material.

* * * * *